US008522459B2

(12) United States Patent
Pavan

(10) Patent No.: US 8,522,459 B2
(45) Date of Patent: Sep. 3, 2013

(54) SUBMERGIBLE DENSIFICATION CELL, SEDIMENT SEPARATOR AND SEDIMENT DENSIFICATION METHOD

(76) Inventor: Paulo Pavan, Guararema (BR)

( * ) Notice: Subject to any disclaimer, the term of this patent is extended or adjusted under 35 U.S.C. 154(b) by 769 days.

(21) Appl. No.: 12/439,630

(22) PCT Filed: Jul. 30, 2007

(86) PCT No.: PCT/BR2007/000192
§ 371 (c)(1),
(2), (4) Date: Nov. 9, 2009

(87) PCT Pub. No.: WO2008/025106
PCT Pub. Date: Mar. 6, 2008

(65) Prior Publication Data

US 2010/0175283 A1 Jul. 15, 2010

(30) Foreign Application Priority Data

Aug. 28, 2006 (BR) ..... 0603639

(51) Int. Cl.
*E02F 3/94* (2006.01)

(52) U.S. Cl.
USPC ..... 37/320

(58) Field of Classification Search
USPC ..... 37/310, 317–324, 333, 343, 345; 166/352, 354, 357, 348, 265, 267, 302, 303, 166/370–372; 405/163, 164; 299/8, 9
See application file for complete search history.

(56) References Cited

U.S. PATENT DOCUMENTS

| | | | | |
|---|---|---|---|---|
| 3,659,712 | A | | 5/1972 | Chaplin |
| 4,053,181 | A | * | 10/1977 | Saito ..... 299/9 |
| 5,421,105 | A | | 6/1995 | Schulte |
| 5,546,682 | A | * | 8/1996 | Skerry ..... 37/322 |
| 5,950,732 | A | * | 9/1999 | Agee et al. ..... 166/354 |
| 5,970,635 | A | | 10/1999 | Wilmoth |
| 6,209,965 | B1 | | 4/2001 | Borns et al. |

FOREIGN PATENT DOCUMENTS

| | | |
|---|---|---|
| CA | 2534156 A1 | 7/2006 |
| DE | 4416591 C1 | 6/1995 |
| GB | 2025484 | 1/1980 |
| JP | 62204810 | 9/1987 |
| JP | 02248535 | 10/1990 |
| WO | WO 02/057551 A1 | 7/2002 |

* cited by examiner

*Primary Examiner* — Robert Pezzuto
(74) *Attorney, Agent, or Firm* — Alston & Bird LLP

(57) ABSTRACT

The present invention relates to a sediment/water separator used to dredge sediment from the bottom of lakes, rivers, harbors, lagoons, tanks, dykes, reservoirs and seashore. The invention, also named submergible densification cell, dredges sediment of various types at various depths. The sediment can vary as far as their consistency, contamination, stratigraphy, density, origin, concentration, granulometry and other aspects of its formation are concerned. The invention also relates to a sediment densification method which utilizes the submergible densification cell, resulting in an increase of 1.5 to 3 times (by weight) in the concentration of the dredged sediment, reducing the removed volume, the area necessary for deposition, and, as a result, accelerating the open-air drying process of the dredged sediment.

16 Claims, 8 Drawing Sheets

SUBMERGIBLE DENSIFICATION CELL, SEDIMENT SEPARATOR AND SEDIMENT DENSIFICATION METHOD

The present invention relates to a sediment/water separator used to dredge sediment from the bottom of lakes, rivers, harbors, lagoons, tanks, dykes, reservoirs, seashore and effluent treatment plants. It can also be used in the environmental field, in building construction, in chemistry and in other fields whenever the separation and removal of sediment particles are required.

STATE OF THE ART

Techniques for removing sediment particles deposited in the bottom of water reservoirs were developed in the prior art and are widely known and used nowadays.

Canadian patent application CA 2534156 describes an apparatus for sediment removal and a method for removing sediment from bodies of water by using a versatile and controllable device, in a manner that avoids generating unwanted turbidity. By using a suction pump and with the aid of compressed air, water and sediment drawn through a conduit are transported to retention containers and removed by tank trucks for subsequent treatment. The equipment which is the object of said Canadian application enables sediment removal from depths greater than 25 feet.

Patent application DE 4416591 concerns a method for cleaning polluted sediment in bodies of water and equipment for implementation of said method. During the operation, the equipment in question remains on a floatable platform while the sediment is sucked up from the bed with the aid of compressed air and conducted to a main pipe. The sediment is removed by mechanical, hydraulic or pneumatic means and then dried and transported for subsequent treatment. External turbidity is avoided through the use of light material which remains in water, forming a protective ring that isolates the working area.

Patent application WO 02/057551 describes a method for hydraulic subsea dredging of sediment from areas of the sea bottom, water reservoirs etc, including a first operational step in which the sediment is sucked or pumped through a pipe to a second level located below the natural water surface utilized to enhance the required suction or pump capacity. At said second level, the sediment is stored in a container being accessible by mechanical equipment arranged over the water surface, from which container the sediment is removed by conventional pumps or by other conventional removal methods.

Document U.S. Pat. No. 5,421,105 is directed to dredging, and, more particularly, to a closed circuit dredging system which circulates the water removed from a dredging area back to the dredging apparatus to mix with the dredged solids so as to prevent clogging of the dredging apparatus. The proposed system allows a continuous sediment dredging with a minimal disturbance of the surrounding areas, minimizing its influence on the ecosystem.

Although other relevant documents can be found in patent literature, the described equipment and removal methods share the same drawback, namely, the need for exhaustive subsequent treatment of the dredged material. Said subsequent treatment includes the utilization of large drying areas or dredged material sedimentation tanks, as solids must be separated off from the liquid portion which was also dredged.

The invention in question is within the abovementioned context. The invention described herein is named "submergible densification cell"; it dredges sediment from the bottom of water reservoirs at various depths, without causing turbidity of bodies of water and with simultaneous densification of dredged material, reducing the need for subsequent treatment aimed at separating off water from sediment.

The invention involves a pumping system equipped with a densification cell which is responsible for the densification of the solids encountered in the pumped water. The solid-liquid mixture obtained in the external tank will have a higher concentration of solids than the mixture which is traditionally obtained. In addition, said densification cell minimizes turbidity of the aqueous system, avoiding major damage to the ecosystem.

OBJECTS OF THE INVENTION

The present invention is directed to a submergible densification cell the aim of which is to remove sediment from the bottom of lakes, rivers and other bodies of water. Said removal is preceded by densification, that is, higher concentration of said sediment so it can further be dredged from the bottom of said bodies of water.

BRIEF DESCRIPTION OF THE INVENTION

The objects of the present invention are achieved by providing a submergible densification cell 10 comprising:

a) a sediment collection area 1 having a front section 11 delimited by an area A1 and a back section 12 delimited by an area A2;
b) at least one suction and ejection pipe 2 associated with the back portion 12 of the sediment collection area 1;
c) at least one positive displacement pump associated with the suction and ejection pipe 2;
d) an oscillator valve 4 associated with the suction and ejection pipe 2;
e) A conduit to eject the dense sediment 5.

wherein:

the relation A1/A2 comprises an absolute value between 8 and 120;

the front section (11) of the sediment collection area has a maximum area (A1) of 50 $m^2$;

the back section (12) of the sediment collection area has a maximum area (A2) of 0.8 $m^2$;

the front section (11) and the back section (12) keep a mutual distance of 2.0 cm to 10 m;

In addition, the objects of the present invention are achieved by a sediment separator which comprises the above defined submergible densification cell 10.

Further, the objects of the present invention are achieved by a sediment densification method which utilizes the above defined submergible densification cell 10.

BRIEF DESCRIPTION OF DRAWINGS

The present invention will be further described in more details based on one example of execution represented in the drawings: The figures show.

DETAILED DESCRIPTION OF THE INVENTION

Figure 1:
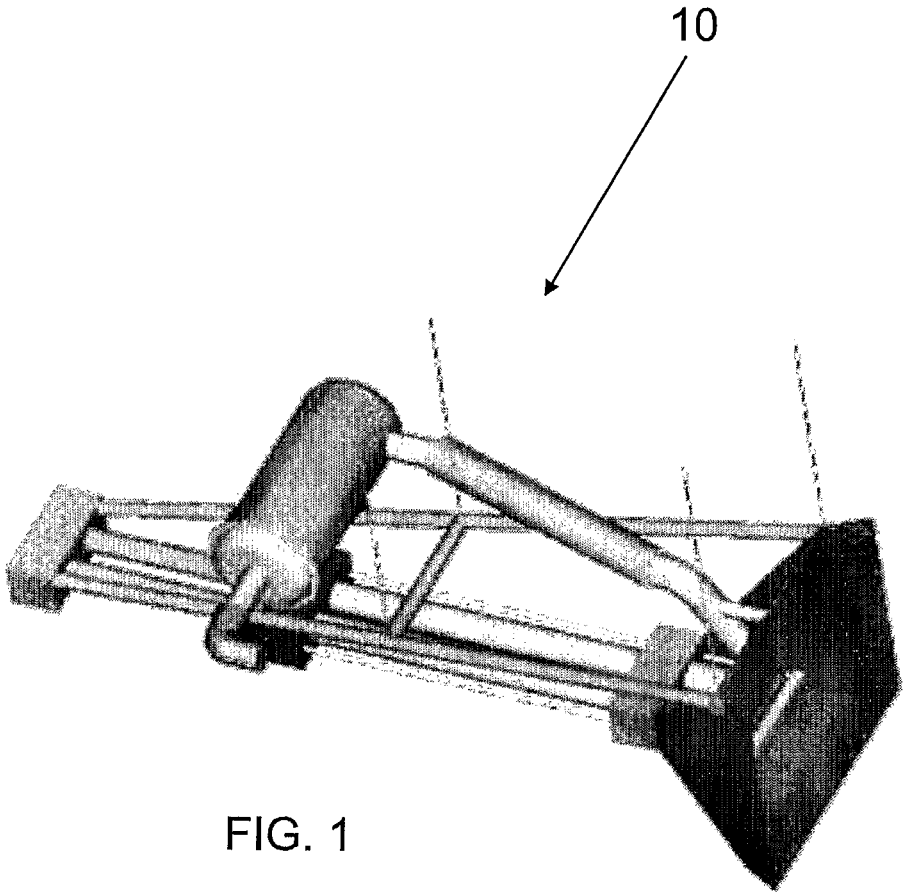
FIG. 1—view in perspective of the submergible densification cell 10.

The invention relates to a submergible densification cell 10, also called a sediment/water separator, which dredges sediment from the bottom of water reservoirs and/or natural/artificial water courses. The invention can be used to dredge sediment from the bottom of lakes, rivers, harbors, lagoons, tanks, dykes, reservoirs, seashore and effluent treatment plants at various depths. Said sediment can vary as far as its consistency, contamination, stratigraphy, density, origin, concentration, granulometry and other geological aspects of its formation are concerned.

As no turbulent flow is verified with the use of the densification cell in question to dredge sediment 10, the use of plastic barriers, stoplogs or cutoffs—which are currently necessary in conventional dredging methods—can be eliminated. When the current methods are used, turbulent flow is verified in the aqueous or solvent medium due to the high speed of sediment dredging and sediment removal of said methods, which make the finest sediment particles whirl and scatter. If the sediment is contaminated, the problem becomes insoluble and any current dredging method becomes unfeasible. Thus, the densification cell provides the only viable solution to contaminated sediment dredging.

The advantage of the present invention lies in the fact that sediment can be removed without causing any turbulent flow in water or solvent. Accordingly, the use of plastic barriers, stoplogs or cutoffs—which are currently necessary in conventional dredging methods—can be eliminated. Furthermore, said method has another advantage because the concentration (by weight) of the dredged sediment is increased in 1.5 to 3 times, accelerating the open-air drying process of the dredged sediment and eliminating the need for a large deposition site, due to the significant reduction in volume at removal stage. On the other hand, the drying process of the sediment dredged through conventional methods requires a large deposition location and a much longer drying process.

The densification cell 10, object of the present invention, densities in-water bottom sediment, separating off the solids from the water and increasing their concentration. The method reduces substantially the amount of water (or any other solvent) involved in the transportation of the sediment at the removal stage. The concentration of the bottom sediment increases from, for instance, 5% in average to 10%-15% at the removal stage. The densification cell 10 does not return the water to the sediment point of origin; drying occurs by evaporation. Open-air drying of a type of sediment whose increase in concentration (weight) occurs rapidly does hot require large deposition locations due to the significant reduction in volume at the removal stage. Current conventional dredging with high flow rates of about 150 $m^3$/h has a concentration of about 1 percent and involves the use of a large amount of water for sediment removal, which must be recirculated. Thus, a large deposition location is required for the drying process that will be time-consuming (years).

Due to its design, the densification cell 10 allows the utilization of the bodies of water (lakes, lagoons, rivers, etc.) during its operation, that is, at the removal stage. Due to the use of large amounts of water, the current dredging and removal methods demand temporary interruption in the utilization of the aquifers, resulting in disturbance and additional costs.

Said cell 10 can operate at great depths. It works on flat ploughings and with accurate depth. The densification cell 10 removes the sediment with a precise depth. Dredging apparatus currently used in demolition sucks up sediment at a high flow rate, digging "caves" (wells) in an uncontrollable and inefficient manner.

The densification cell of the present invention comprises:

a) a sediment collection area 1 having a front section 11 delimited by an area A1 and a back section 12 delimited by an area A2;
b) at least one suction and ejection pipe 2 associated with the back section 12 of the sediment collection area 1;
c) at least one positive displacement pump 3 associated with the suction and ejection pipe 2;
d) an oscillator valve 4 associated with the suction and ejection pipe 2 and
e) a conduit to eject the dense sediment 5, wherein:
f) the relation A1/A2 comprises an absolute value between 8 and 120;
g) the front section (11) of the sediment collection area has a maximum area (A1) of 50 $m^2$;
h) the back section (12) of the sediment collection area has a maximum area (A2) of 0.8 $m^2$;
i) the front section (11) and the back section (12) keep a mutual distance of 2.0 cm to 10 m;

Preferably, the relation A1/A2 of the densification cell 10 of the present invention comprises an absolute value between 8 and 15. More preferably, the relation A1/A2 of the densification cell is 10.

Figure 2:
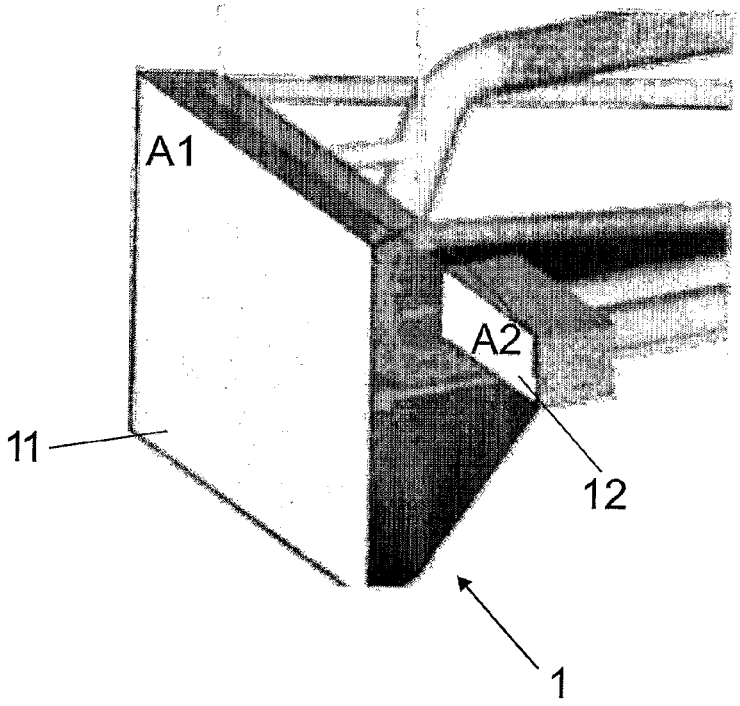
FIG. 2—view in perspective of the sediment collection area 1 having a front portion 11 delimited by an area A1 and a back portion 12 delimited by an area A2.
Figure 3:
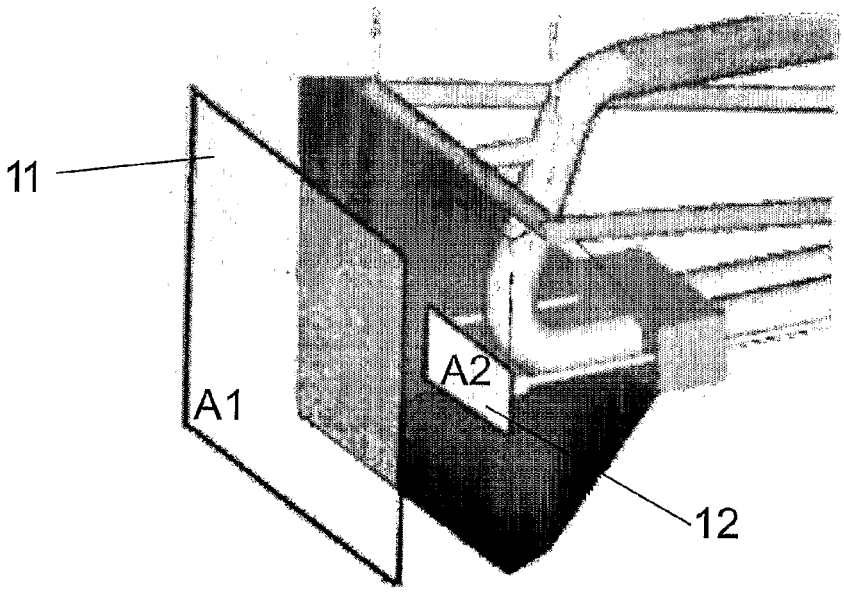
FIG. 3—view in perspective of the sediment collection area 1 having a front portion 11 delimited by an area A1 in highlight and a back portion 12 delimited by an area A2 in highlight.

The densification cell 10 of the present invention causes primary densification, that is, an increase in the concentration of the fine submerged sediment. This is due to a drastic area reduction (around at least 8 times) of sections 11 and 12 of the sediment collection area 1 delimited by the areas A1 and A2, as shown in FIGS. 2 and 3, when said sediment undergoes the pressure generated by the positive displacement pump (piston) 3, making it enter the front section 11 of the sediment collection area 1 delimited by area A1 which is, at least 8 times larger than area A2 which delimits the back section 12 of the sediment collection area 1. The great suppression generated by the loading in a confined space causes an increase in pressure between the sediment particles and the cell walls; expelling the interstitial water trapped in the sediment to the aqueous medium (in the event water is the predominant liquid medium).

Preferably, area A1 which delimits the front section 11 of the sediment collection area 1 of the densification ceil 10 of the present invention has a maximum value of 8 $m^2$. Even more preferably, area A1 has a value of 6 $m^2$. Area A2 which delimits the back section 12 of the sediment collection area 1 of the densification cell 10 of the present invention has, preferably, a maximum value of 0.3 $m^2$. However, the relation A1/A2 must forcefully be an absolute value between 8 and 120, as previously mentioned.

So as to ensure suitable primary densification, that is, so as to ensure that a smaller amount of water enters the densification cell itself 10 through the "wall" of the dense material, said areas A1 and A2 should preferably lay parallel and distant to one another according to the following formula:

wherein:

$$d \geq C \times Q \times \left(\frac{A_i}{A_2}\right)$$

d=distance between the areas [m]

C=constant of the material to undergo densification

Q=suction flow rate [$m^3$/h], $A_1$=area 1—area which delimits the front section 11 of the sediment collection area 1 [$m^2$]

$A_2$=area 2—area which delimits the back section 12 of the sediment collection area 1 [$m^2$]

and: wherein:

$$Q = v \times A$$

v=suction velocity [m/h]

Constant C is an absolute value which ranges from 0.002 to 0.004 and depends on the type of material to be introduced in the densification cell. For organic clay, the value of the constant C is approximately 0.002. For the mud generated in an effluent treatment plant, the value of C is around 0.003.

In the submergible densification cell 10 of the present invention, the front section 11 of the sediment collection area 1 and the back section 12 of the sediment collection area 1 preferably keep a mutual distance of 50 cm to 1.10 m. Even more preferably, the distance between the front section 11 of the sediment collection area 1 and the back section 12 of the sediment collection area 1 is 1.0 m.

In the submergible densification cell 10 of the present invention, the water/sediment mixture is sucked by a positive displacement pump 3 associated with the suction and ejection pipe 2. The positive displacement pump 3 of the submergible densification cell 10 comprises at least a piston. Preferably, the submergible densification cell 10 of the present invention comprises two pistons; each of said piston is located inside its respective suction and ejection pipe 2.

In a preferred embodiment of the present invention, the two pistons which comprise the positive displacement pump 3 work alternately, that is, while one piston sucks up the sediment and places it inside the suction and ejection pipe 2, the other piston makes the inverse movement, that is, it expels the sediment that has already been sucked up and sends it to the outlet conduit 5 through an oscillator valve 4.

Figure 6:
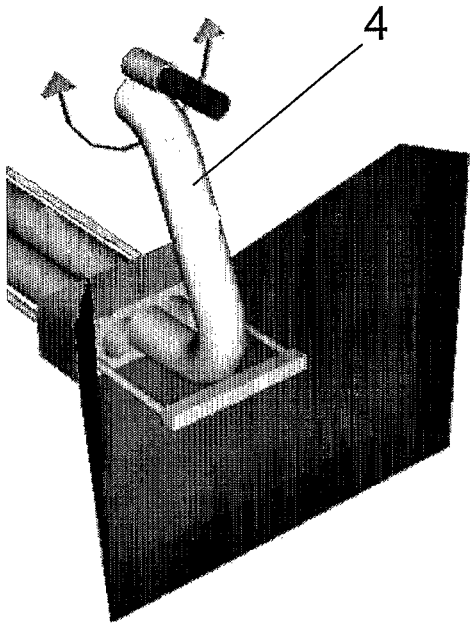
FIG. 6—view in perspective of the oscillator valve 4 associated with the suction and ejection pipe 2.
Figure 7:
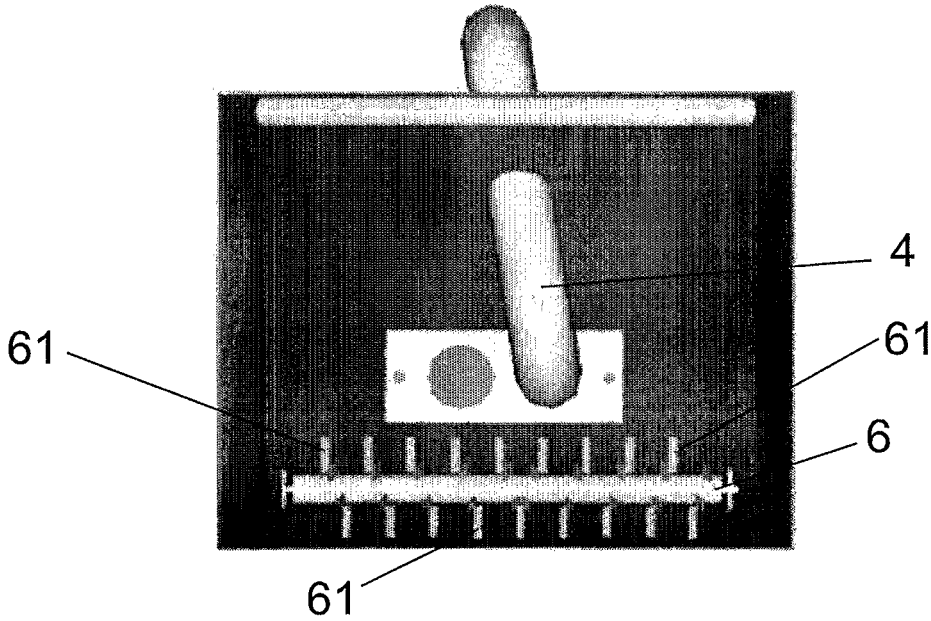
FIG. 7—front view of the sediment collection area 1 comprising a rotary mixer 6.
Figure 8:
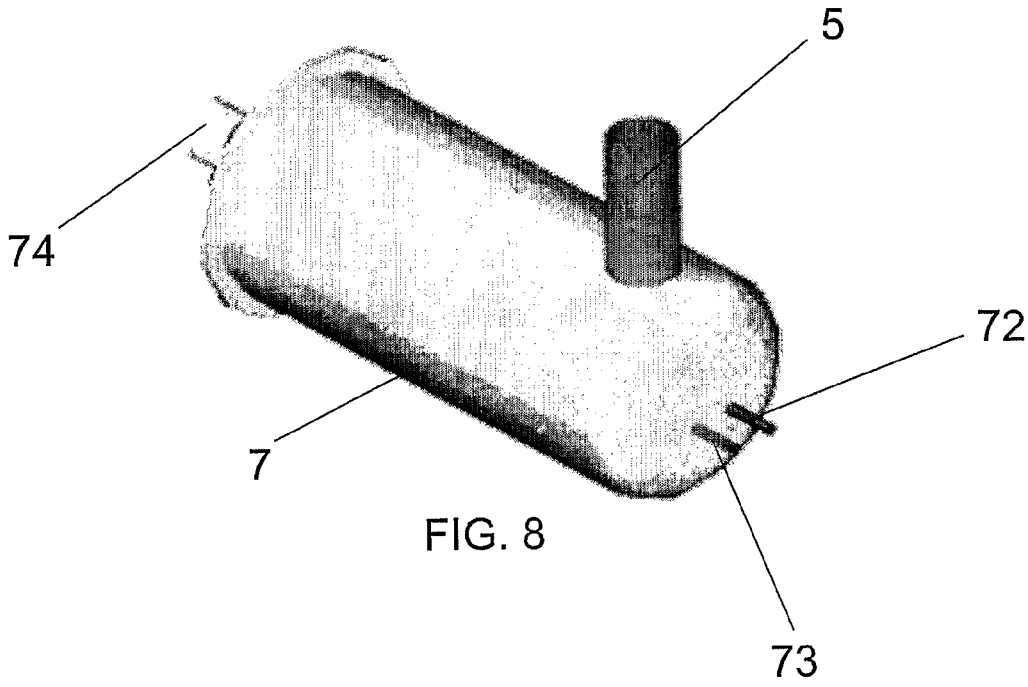
FIG. 8—view in perspective of the sediment compressor 7 in cooperation with the outlet conduit 5 and comprising an air inlet area 72 and a water outlet area 73.
Figure 9:
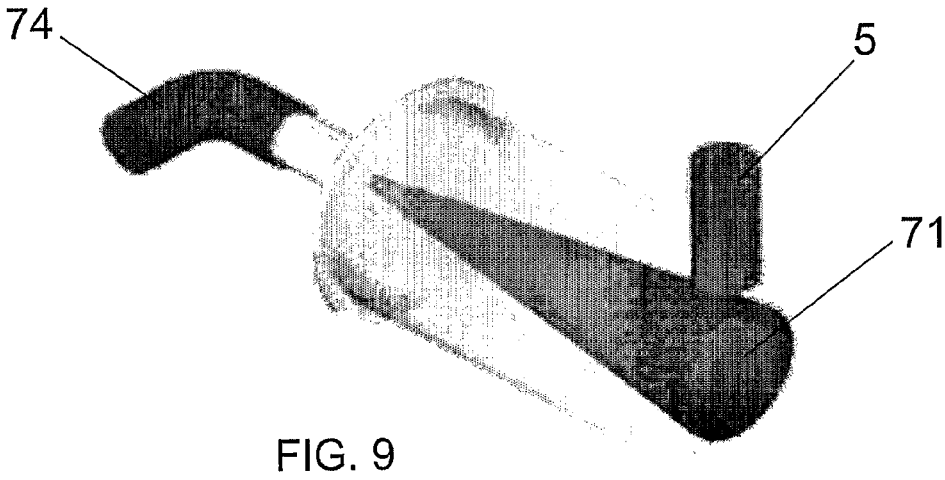
FIG. 9—detailed view of the sediment compressor 7, of the outlet conduit 5 and of the draining cone 71.

The oscillator valve 4 connects the piping 2 which is responsible for propelling the sediment towards the outlet conduit to eject the dense sediment 5. Said valve 4 is called oscillator valve because of its alternating functions of interconnecting a section of the suction and ejection pipe 2 to the outlet conduit 5, and interconnecting the other section of the suction and ejection pipe to the outlet conduit, according to the movement of the piston 3 at the time, as shown in FIG. 6. After going through the outlet conduit 5, the sediment can be placed on the shore of the water reservoirs. Prior to riparian placement, the dense sediment can also be directed to a sediment compressor 7.

Preferably, but not compulsorily, the submergible densification cell 10 can comprise a sediment compressor 7 which works in cooperation with the outlet conduit 5. The sediment compressor described herein is composed of a dredging cone 71, an air inlet area 72 and a water outlet area 73.

The sediment compressor 7 is responsible for a more effective water/solid separation and is preferably used to density sediment with a(n) (absolute) density close to the environment it belong in. In the case of water-mixed sediment, the densities may reach 1.00 kg/liter (from 1.03 to 1.10 kg/liter).

The mode of operation of the sediment compressor 7 and of the densification cell 1 itself is based on the same principle. In other words, there also occur a drastic reduction in diameter and an arch formation (clogging) over, a membrane which is intermittently cleaned by air injection. The air injection is intermittent. For example, it occurs every 30 seconds and is 1 second long. The sediment compressor 7 receives the mixture which was pressurized by the positive displacement pump 3. It also receives compressed air pressure through the air outlet area 72, which expels the exuding water from the compressor 7 through the water outlet area 73.

Sediment whose density is very similar to its surrounding medium requires more pressure to become dense. Therefore, the compressor plays an essential role in the process.

From the compressor 7, the sediment is pumped out of the densification cell 10 at a flow rate of up to 1500 $m^3$/h approximately. It is then transferred through a conduit 74 toward the shore of the river or the lake, where it is dumped, for the drying process to start.

As the concentration of the sediment removed by the submergible densification cell 10 is higher than the concentration of the sediment removed by the apparatuses described in the prior art, its drying time is reduced.

In a preferred embodiment of the present invention, the submergible densification cell 10 is also equipped with a rotary mixer 6 responsible for mixing the sediment with rather variable stratigraphy in its granulometry, such as, for instance, a clean sand strip sedimented on fine mud. Due to its draining characteristics, the sand needs to be internally mixed in the densification cell so as to be transported with the fine mud. In fact, if it were not for the mixing process, the fine mud would cross the sand layer during the suction process, due to sand compactation. The rotary mixer 6 disaggregates the sand grains, making the fine mud transport the sand to the arch wherefrom it is subsequently transported through the piping.

The rotary mixer 6 comprises a set of steel blades 61 arranged in rays and helicoidally distributed, having constant speed and forming a 45° angle in relation to one another, in two opposite halves, from the ends to the center. The direction of rotation causes the sand-mud mixture to be transported while it is mixed and accumulate in the center of the collection area (Area A1). The rotary mixer 6 is located inside the sediment collection area 1. Its operation does not affect the medium and does not generate water turbidity.

A screen (not depicted) can be placed close to the rotary mixer. The function of said screen is to prevent bigger objects other than mud from entering and damaging the densification cell, impairing its operation.

The present invention also relates to a sediment separator comprising a submergible densification cell 10 like the one described in the present invention.

The present invention is further directed to a sediment densification method, which utilizes a submergible densification cell 10 operating at a maximum suction flow rate of 1500 $m^3$/h. The submergible densification cell 10 comprises:

a) a sediment collection area 1 having a front section 11 delimited by an area A1 and a back section 12 delimited by an area A2;

b) at least one suction and ejection pipe 2 associated with the back section 12 of the sediment collection area 1;

c) at least one positive displacement pump 3 associated with the suction and ejection pipe 2;

d) an oscillator valve 4 associated with the suction and ejection pipe 2 and e) a conduit to eject the dense sediment 5, wherein:

a) the relation A1/A2 comprises an absolute value between 8 and 120;

b) the front section (11) of the sediment collection area has a maximum area (A1) of 50 $m^2$;

c) the back section (12) of the sediment collection area has a maximum area (A2) of 0.8 $m^2$;

d) the front section (11) and the back section (12) keep a mutual distance of 2.0 cm to 10 m;

The sediment densification method of the present invention occurs, preferably, at a maximum flow rate of 50 $m^3$/h. More preferably, the maximum suction flow rate of the sediment densification method of the present invention is 10 $m^3$/h.

Figure 10:
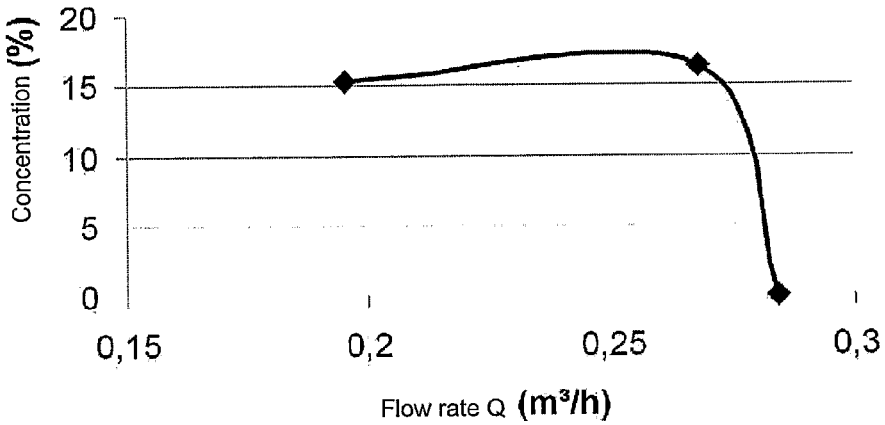
FIG. 10—graph demonstrating the concentration values pursuant to table 1.

As aforementioned, the concentration of the water/sediment mixture is closely related to the suction velocity, and, accordingly, to the inlet flow rate. Table 1 below and FIG. 10 (graph generated from table 1) show the results obtained from a practical example in which the densification cell 10 and the sediment densification method of the present invention were used. As shown, within the flow rate range used, the concentration of the mixture increased according to the increase in the sediment suction flow rate (for the mud generated in an effluent treatment plant).

TABLE 1

| Q ($m^3$/h) | Concentration (%) |
|---|---|
| 0.195 | 15.4 |
| 0.268 | 16.4 |
| 0.284 | 0 |

The data described in table 1 were obtained during the dredging of a 26 liter water-sediment mixture from a randomly assigned ploughed area at the bottom of a lake. On said dredging, a densification cell having the following dimension was utilized:

Area A1=0.3 $m^2$

Area A2=0.0025 $m^2$

Distance between the planes of the areas d=0.5 m

Suitable flow rates, that is, lower than 1500 $m^3$/h flow rates, increase the efficiency of the method and prevent the sediment from being detached from the bottom of the bodies of water (ressuspension). For instance, lower than 1 m/min inlet speeds concomitant with the collection area A1=2 $m^2$ and area A2=0.2 $m^2$ cause a pressure arc on the sediment, that is, an outlet congestion between the outlet area and the cell walls 10. Accordingly, new sediment particles are additionally dragged, through the inlet area A1 (collection) to the arch by the movement of the cell 10 against the bottom deposits. The new sediment layers are dehydrated and regularly and continuously pumped out up to the end.

The shape of the densification cell 10 can vary according to the flow, rate and the type of sediment. Said shape variation is achieved by changing the relation between A1/A2 and the distance between said areas (corresponding to the front section 11 and the back section 12 of the sediment collection area 1) so a better yield is obtained. Preferably, areas A1 and A2 have a square shape because experiments carried out proved that the square shape was the shape that enabled formation of the pressure arch between the cell walls and facilitated ploughing. However, other shapes can be used.

The water/sediment separator or submergible densification cell 10 operates by submersion, densifying the sediments in order to obtain concentrations that are higher than the traditionally obtained ones. The equipment is hydraulic-mechanical and no chemical flocculants or binders are required for the sediment densification or dehydration to occur.

Figure 4:
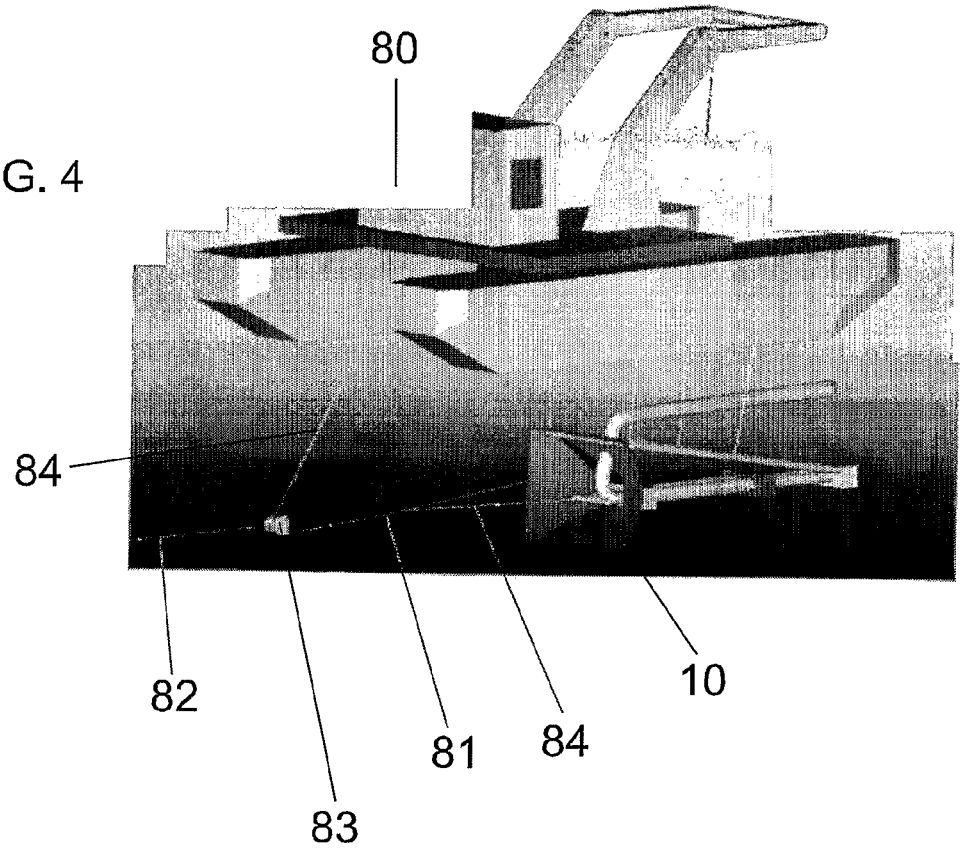
FIG. 4—schematic view of the sediment/water separation system including the submergible densification cell 10 and a vessel 80 with shroud lines.
Figure 5:
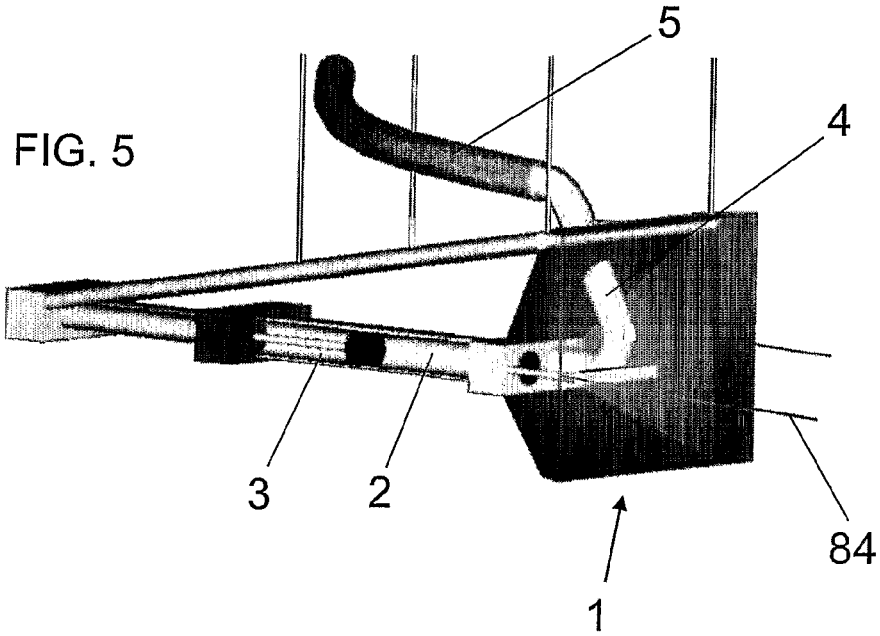
FIG. 5—detailed view of the submergible densification cell 10, where the hydraulic piston 3, the oscillator valve 4, the suction and ejection pipe 2 and the conduit to eject the dense sediment 5 can be seen.

The cable system 81 that can be utilized in the operation of the submergible densification cell 10 of the present invention is part of the equipment and can be seen in FIG. 4. One end of the cable 82 anchored to the submergible berth has a snatch block 83 connected to a drag cable 84 that comes from the hydraulic winch at the vessel; the other end is anchored to the densification cell 10. This minimizes the wave effect and enables sediment removal according to a desired alignment and considerable directed thrust.

Figure 11:
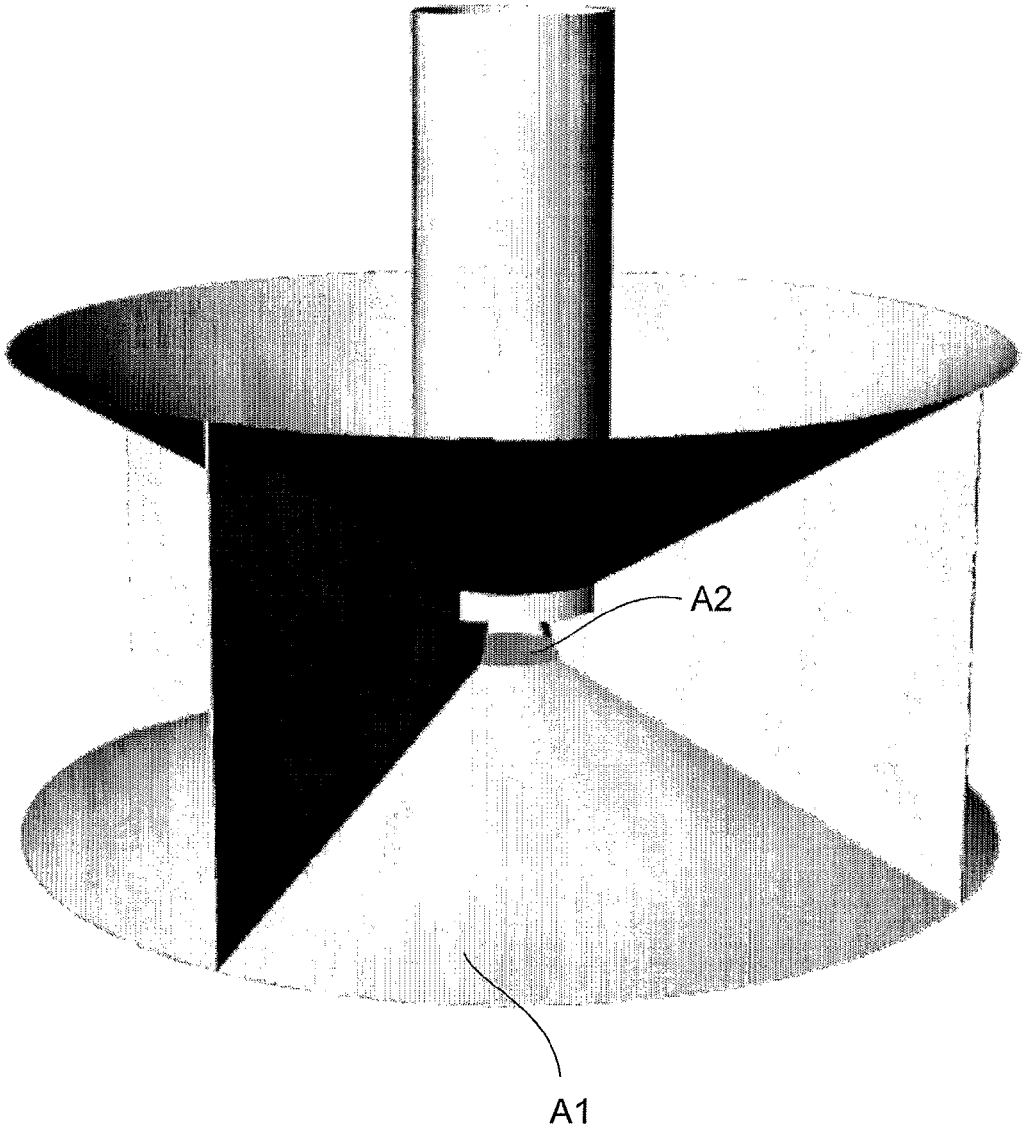
FIG. 11—view in perspective of a preferred embodiment of the sediment collection area 1.

In a preferred embodiment of the invention shown in FIG. 11 the sediment collection area has at least an arch-shaped or cylinder-shaped front portion 11 delimited by an area A1 and an arch-shaped or cylinder-shaped back portion 12 delimited by an area A2.

Figure 12A:
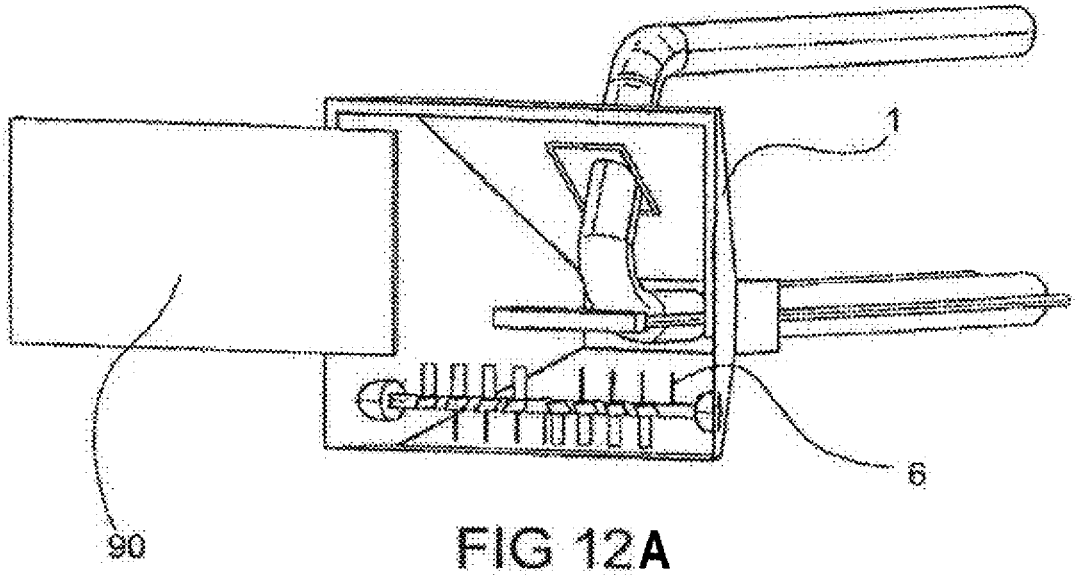
FIG. 12—view in perspective of another preferred embodiment of the sediment collection area 1 which utilizes a lid 90.
Figure 12B:
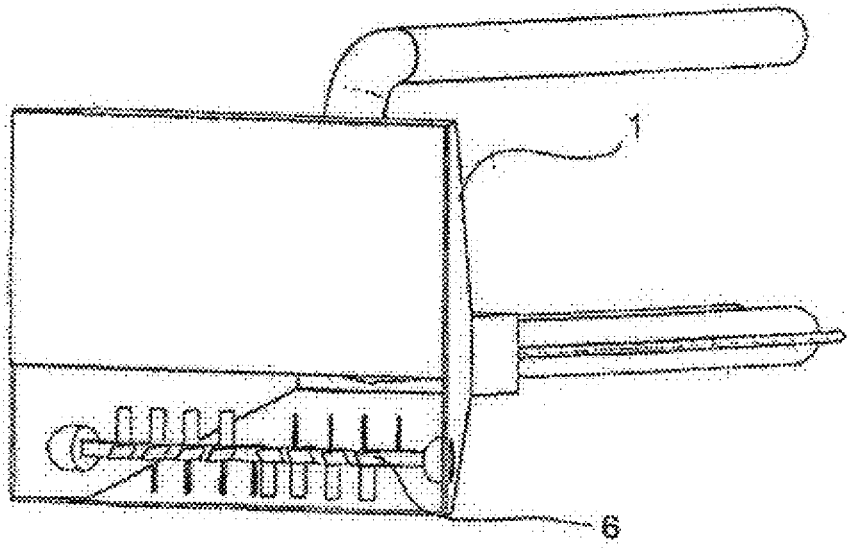

In another preferred embodiment of the invention, as shown in FIG. 12, the front section 11 delimited by area A1 is partially covered by a lid 90, whose purpose is to annul any turbidity that might be generated by the oscillator valve operation 4.

Having described an example of the invention with reference to its preferred embodiment, it is to be understood that the scope of the present invention embraces other possible variations, being limited solely by the appended claims, including the possible equivalents therein.

The invention claimed is:

1. Submergible densification cell comprising:

a) a sediment collection area having a front section delimited by a first area A1 and a back section delimited by a second area A2;

b) at least one suction and ejection pipe connected to the back section of the sediment collection area;

c) at least one positive displacement pump in fluid communication with the suction and ejection pipe;

d) an oscillator valve connected to the suction and ejection pipe; and e) a conduit to eject the sediment, wherein:

A1/A2 comprises an absolute value between 8 and 120;

the first area A1 does not exceed 50 $m^2$;

the second area A2 does not exceed 0.8 $m^2$; and the front section and the back section spaced apart by a distance of between 2.0 cm to 10 m.

2. Submergible densification cell according to claim 1, wherein A1/A2 comprises an absolute value between 8 and 15.

3. Submergible densification cell according to claim 2, wherein A1/A2 is 10.

4. Submergible densification cell according to claim 1, wherein the first area A1 area does not exceed 8 $m^2$.

5. Submergible densification cell according claim 1, wherein the first area A1 does not exceed 6 $m^2$.

6. Submergible densification cell according to claim 1, wherein the second area A2 does not exceed 0.3 $m^2$.

7. Submergible densification cell according to claim 1, wherein the front section and the back section are spaced apart by a distance of between 50 cm to 1.1 m.

8. Submergible densification cell according to claim 1, wherein the front section and the back section are spaced apart by a distance of 1 m.

9. Submergible densification cell according to claim 1, wherein it also comprises a rotary mixer.

10. Submergible densification cell according to claim 1, further comprises a sediment compressor that cooperates with the outlet conduit.

11. Submergible densification cell according to claim 10, wherein the sediment compressor comprises a dredging cone, an air inlet area and a water outlet area.

12. Submergible densification cell according to claim 1, wherein the positive displacement pump comprises at least a piston.

13. Sediment separator comprising: a submergible densification cell that includes:

a) a sediment collection area having a front section delimited by a first area A1 and a back section delimited by a second area A2;

b) at least one suction and ejection pipe connected to the back section of the sediment collection area;

c) at least one positive displacement pump in fluid communication with the suction and ejection pipe;

d) an oscillator valve connected to the suction and ejection pipe; and e) a conduit to eject the sediment, wherein:

A1/A2 comprises an absolute value between 8 and 120;

the first area A1 does not exceed 50 $m^2$;

the second area A2 does not exceed 0.8 $m^2$; and the front section and the back section are spaced apart by a distance of between 2.0 cm to 10 m.

14. Sediment densification method comprising the steps of:

providing a submergible densification cell that includes:

a) a sediment collection area having a front section delimited by a first area A1 and a back section delimited by a second area A2;

b) at least one suction and ejection pipe connected to the back section of the sediment collection area;

c) at least one positive displacement pump in fluid communication with the suction and ejection pipe;

d) an oscillator valve connected to the suction and ejection pipe;

e) a conduit to eject the dense sediment; and wherein:

A1/A2 comprises an absolute value between 8 and 120;

the first area A1 does not exceed 50 $m^2$;

the second area A2 does not exceed 0.8 $m^2$ ;

the front section and the back section are spaced apart by a distance of between 2.0 cm to 10 m;

operating said densification cell with a maximum suction flow rate of 1500 $m^3$/h.

15. Sediment densification method according to claim 14, wherein said densification cell is operated with a maximum suction flow rate of 50 $m^3$/h.

16. Sediment densification method according to claim 14, wherein said densification cell is operated with a maximum suction flow rate of 10 $m^3$/h.

* * * * *

UNITED STATES PATENT AND TRADEMARK OFFICE

CERTIFICATE OF CORRECTION

PATENT NO. : 8,522,459 B2
APPLICATION NO. : 12/439630
DATED : September 3, 2013
INVENTOR(S) : Pavan It is certified that error appears in the above-identified patent and that said Letters Patent is hereby corrected as shown below:

In the Claims

Column 9, Line 10
"comprises" should read --comprising--

Signed and Sealed this
Nineteenth Day of November, 2013

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,522,459 B2
APPLICATION NO. : 12/439630
DATED : September 3, 2013
INVENTOR(S) : Paulo Pavan It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1146 days.

Signed and Sealed this
Fifteenth Day of September, 2015

Michelle K. Lee

Michelle K. Lee
*Director of the United States Patent and Trademark Office*